US006240590B1

(12) United States Patent
Nesbit

(10) Patent No.: US 6,240,590 B1
(45) Date of Patent: Jun. 5, 2001

(54) GROUT SCRUBBER

(76) Inventor: Colette L. Nesbit, 4550 Cape Cod Cir., Carlsbad, CA (US) 92008

( * ) Notice: Subject to any disclaimer, the term of this patent is extended or adjusted under 35 U.S.C. 154(b) by 0 days.

(21) Appl. No.: 09/405,666

(22) Filed: Sep. 24, 1999

(51) Int. Cl.[7] ..... A47L 13/10

(52) U.S. Cl. ..... 15/210.1; 15/145; 15/176.1; 15/176.2; 15/229.11; 15/160; 15/244.1

(58) Field of Search ..... 15/160, 176.1, 15/176.6, 210.1, 229.11, 229.13, 244.1, 143.1, 145, 176.2

(56) References Cited

U.S. PATENT DOCUMENTS

| | | | | |
|---|---|---|---|---|
| D. 378,959 | | 4/1997 | Gringer | D4/132 |
| 1,027,209 | * | 5/1912 | Margolius | 15/144.3 X |
| 1,807,281 | * | 5/1931 | Cross | 15/176.1 X |
| 1,820,183 | * | 8/1931 | Darling | 15/229.13 |
| 2,679,064 | * | 5/1954 | Palma, Jr. et al. | 15/244.1 |
| 2,742,660 | * | 4/1956 | Van Esley | 15/244.1 X |
| 4,064,588 | | 12/1977 | Cooper | 15/236.01 |
| 4,155,140 | * | 5/1979 | Janssen et al. | 15/210.1 |
| 5,010,615 | * | 4/1991 | Carter | 15/229.13 X |
| 5,224,234 | | 7/1993 | Aesenault et al. | 15/167.1 |
| 5,319,824 | | 6/1994 | Cook, III | 15/160 |
| 5,323,506 | * | 6/1994 | Babitch | 15/210.1 |
| 5,412,829 | | 5/1995 | Hefner | 15/52.1 |
| 5,809,604 | | 9/1998 | Olstyn | 15/111 |

FOREIGN PATENT DOCUMENTS

| | | | | |
|---|---|---|---|---|
| 213674 | * | 5/1956 | (AU) | 15/244.1 |
| 501724 | * | 6/1952 | (BG) | 15/176.1 |
| 488108 | * | 11/1952 | (CA) | 15/244.1 |
| 77869 | * | 5/1983 | (EP) | 15/176.1 |
| 712391 | * | 10/1931 | (FR) | 15/160 |
| 2044089 | * | 10/1980 | (GB) | 15/176.1 |

* cited by examiner

*Primary Examiner*—Mark Spisich

(57) ABSTRACT

A grout scrubber for providing interchangeable scrubber heads having scrubbing pads sized to correspond to a width of a surface being scrubbed to facilitate cleaning of the surface includes a scrubber portion and a handle assembly. The scrubber portion is slidably couplable to the scrubber portion. The scrubber portion includes a slot having angled sides and a nipple for engaging the handle assembly. In an embodiment, a protrusion is positioned on the handle assembly to engage the nipple on the scrubber portion. The handle assembly provides a grip at a distal end of an elongated handle. In an embodiment, the elongated handle is separable into two sections threadingly engageable to each other. Alternately, the handle assembly provides an angled shortened handle having an offset grip for scrubbing surfaces at an elevated level within reach of an upright user. The interchangeable scrubber heads provide various thicknesses and materials to provide flexibility and facilitate selection of a desired scrubber type and style most suitable for cleaning the desired surface.

11 Claims, 3 Drawing Sheets

GROUT SCRUBBER

BACKGROUND OF THE INVENTION

1. Field of the Invention

The present invention relates to scrubbers and more particularly pertains to a new grout scrubber for providing interchangeable brush heads to facilitate use of a brush size corresponding to the surface being scrubbed.

2. Description of the Prior Art

The use of hand held scrubbers is known in the prior art. More specifically, scrubbers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,412,829; U.S. Pat. No. 5,224,234; U.S. Pat. No. 5,809,604; U.S. Pat. No. 5,319,824; U.S. Pat. No. 4,064,588; and U.S. Pat. No. Des. 378,959.

While these devices fulfill their respective, particular objectives and requirements, the aforementioned patents do not disclose a new grout scrubber. The inventive device includes a scrubber portion and a handle assembly. The scrubber portion is slidably couplable to the scrubber portion. The scrubber portion includes a slot having angled sides and a nipple for engaging the handle assembly. In an embodiment, a protrusion is positioned on the handle assembly to engage the nipple on the scrubber portion. The handle assembly provides a grip at a distal end of an elongated handle. In an embodiment, the elongated handle is separable into two sections threadingly engageable to each other. Alternately, the handle assembly provides an angled shortened handle having an offset grip for scrubbing surfaces at an elevated level within reach of an upright user. The interchangeable scrubber heads provide various thicknesses and materials to provide flexibility and facilitate selection of a desired scrubber type and style most suitable for cleaning the desired surface.

In these respects, the grout scrubber according to the present invention substantially departs from the conventional concepts and designs of the prior art, and in so doing provides an apparatus primarily developed for the purpose of providing interchangeable brush heads to facilitate use of a brush size corresponding to the surface being scrubbed.

SUMMARY OF THE INVENTION

In view of the foregoing disadvantages inherent in the known types of scrubbers now present in the prior art, the present invention provides a new grout scrubber construction wherein the same can be utilized for providing interchangeable brush heads to facilitate use of a brush size corresponding to the surface being scrubbed.

The general purpose of the present invention, which will be described subsequently in greater detail, is to provide a new grout scrubber apparatus and method which has many of the advantages of the scrubbers mentioned heretofore and many novel features that result in a new grout scrubber which is not anticipated, rendered obvious, suggested, or even implied by any of the prior art scrubbers, either alone or in any combination thereof.

To attain this, the present invention generally comprises a scrubber portion and a handle assembly. The scrubber portion is slidably couplable to the scrubber portion. The scrubber portion includes a slot having angled sides and a nipple for engaging the handle assembly. In an embodiment, a protrusion is positioned on the handle assembly to engage the nipple on the scrubber portion. The handle assembly provides a grip at a distal end of an elongated handle. In an embodiment, the elongated handle is separable into two sections threadingly engageable to each other. Alternately, the handle assembly provides an angled shortened handle having an offset grip for scrubbing surfaces at an elevated level within reach of an upright user. The interchangeable scrubber heads provide various thicknesses and materials to provide flexibility and facilitate selection of a desired scrubber type and style most suitable for cleaning the desired surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grout scrubber apparatus and method which has many of the advantages of the scrubbers mentioned heretofore and many novel features that result in a new grout scrubber which is not anticipated, rendered obvious, suggested, or even implied by any of the prior art scrubbers, either alone or in any combination thereof.

It is another object of the present invention to provide a new grout scrubber that may be easily and efficiently manufactured and marketed.

It is a further object of the present invention to provide a new grout scrubber that is of a durable and reliable construction.

An even further object of the present invention is to provide a new grout scrubber which is susceptible of a low cost of manufacture with regard to both materials and labor, and which accordingly is then susceptible of low prices of sale to the consuming public, thereby making such grout scrubber economically available to the buying public.

Still yet another object of the present invention is to provide a new grout scrubber which provides in the apparatuses and methods of the prior art some of the advantages thereof, while simultaneously overcoming some of the disadvantages normally associated therewith.

Yet another object of the present invention is to provide a new grout scrubber that includes a scrubber portion and a handle assembly, the scrubber portion being slidably couplable to the scrubber portion.

Yet another object of the invention is to provide a scrubber portion that includes a slot having angled sides and a nipple for engaging a protrusion on the handle assembly. The handle assembly provides a grip at a distal end of an elongated handle. The elongated handle is separable into two sections threadingly engageable to each other. Alternately, the handle assembly provides an angled shortened handle having an offset grip for scrubbing surfaces at an elevated level within reach of an upright user.

Still yet another object of the present invention is to provide interchangeable scrubber heads of various thicknesses and materials to provide flexibility and facilitate selection of a desired scrubber type and style most suitable for cleaning the desired surface.

Still yet another object of the present invention is to provide a new grout scrubber that permits cleaning of a floor or other low elevation surface without having to bend over.

Even still another object of the present invention is to provide a new grout scrubber that provides interchangeable heads to prevent wasteful discarding of a functional handle assembly upon the degradation of a less durable scrubber portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
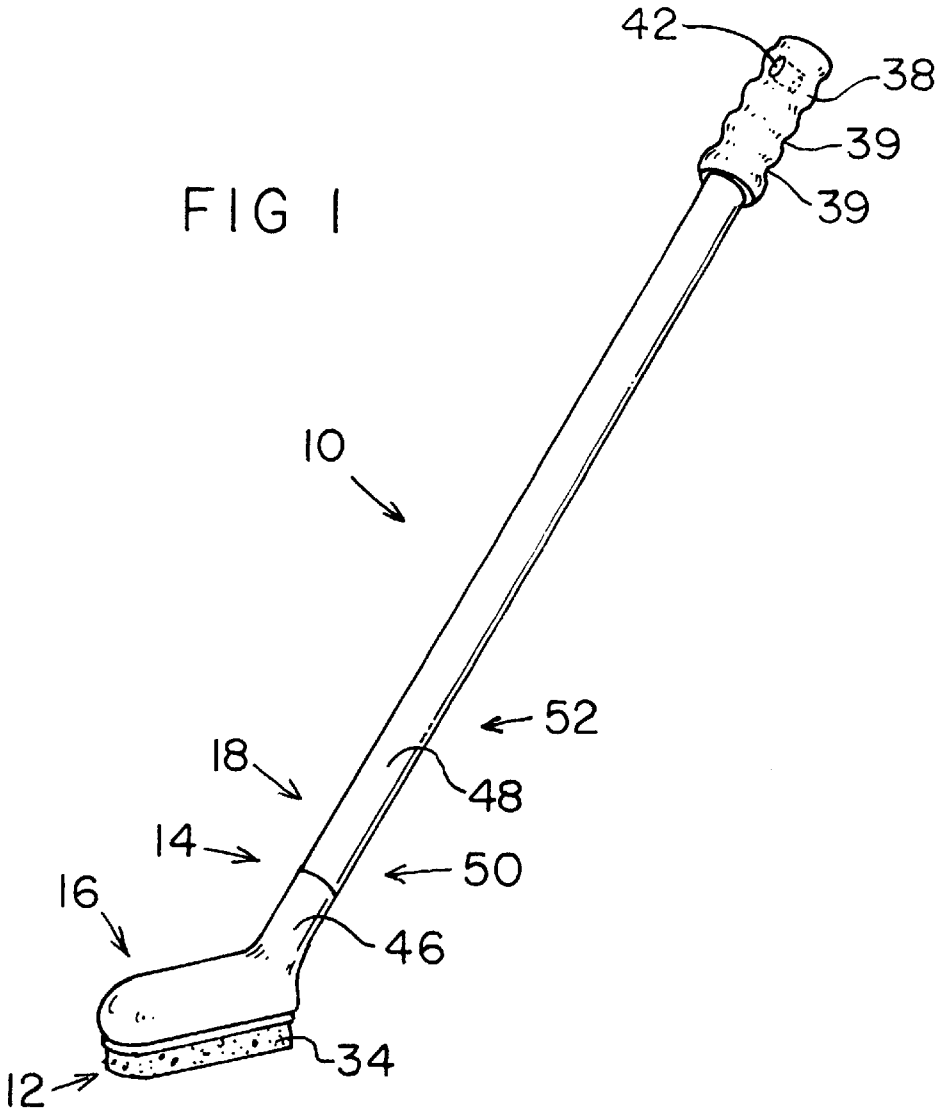
FIG. 1 is a perspective view of a new grout scrubber according to the present invention.
Figure 2:
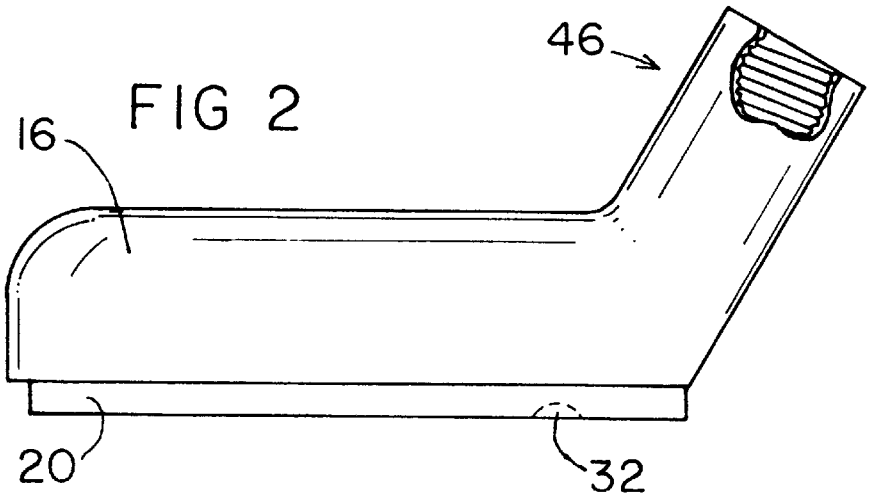
FIG. 2 is a side view of a portion of the handle assembly of the present invention.
Figure 3:
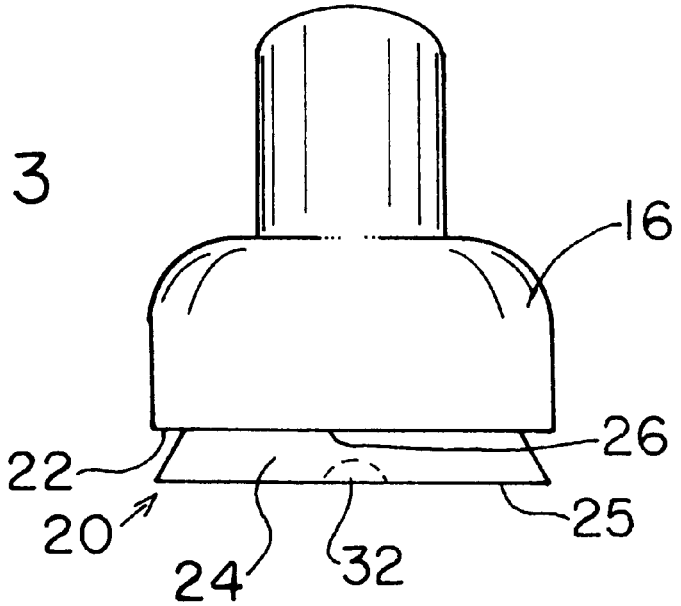
FIG. 3 is a front view of a portion of the handle assembly of the present invention.
Figure 4:
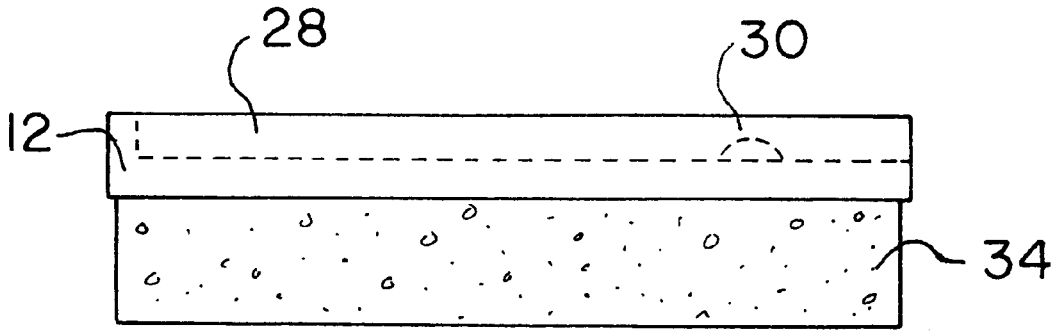
FIG. 4 is a side view of the scrubber portion of the present invention.
Figure 5:
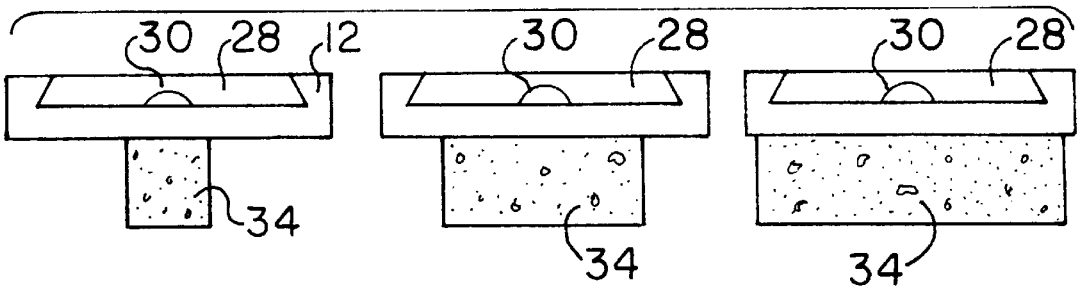
FIG. 5 is a rear view of the scrubber portion of the present invention.
Figure 6:
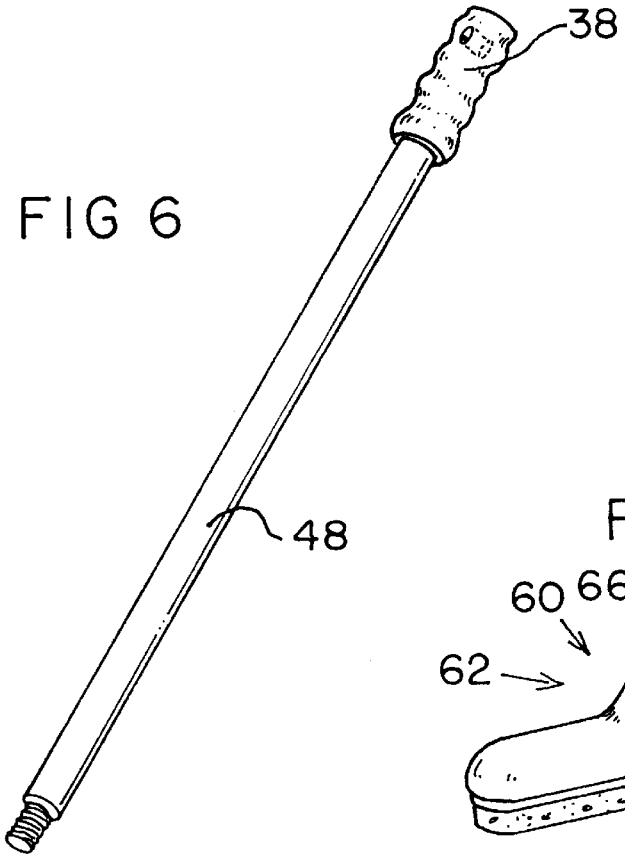
FIG. 6 is a perspective view of a portion of the handle assembly of the present invention.
Figure 7:
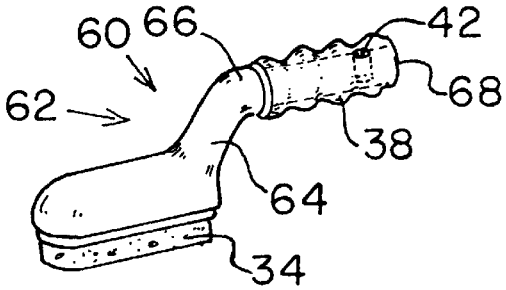
FIG. 7 is a perspective view of an embodiment of the present invention.

With reference now to the drawings, and in particular to FIGS. I through 7 thereof, a new grout scrubber embodying the principles and concepts of the present invention and generally designated by the reference numeral 10 will be described.

As best illustrated in FIGS. I through 7, the grout scrubber 10 generally comprises a scrubber portion 12 and a handle assembly 14 having an engagement portion 16 and a distal portion 18. The distal portion extends outwardly from the engagement portion and is angled relative to the engagement portion. A longitudinal axis of the engagement portion forms a generally obtuse angle relative to a longitudinal axis of the distal portion.

The engagement portion of the handle assembly is slidably couplable to the scrubber portion. An elongated protrusion 20 extends along a lower surface 22 of the engagement portion. The protrusion has a generally trapezoidal cross section 24 taken perpendicular to a longitudinal axis of the protrusion. A length of a distal side 25 of the cross section is longer than a length of a proximal side 26 of the cross section.

The scrubber portion has an elongated slot 28 having a complimentary configuration to the protrusion such that the slot snugly receives the protrusion when the protrusion is slid into the slot. Thus, the scrubber portion is engaged to the engagement portion.

The slot includes a retaining nipple 30 positioned in the slot for engaging the protrusion when the protrusion is inserted into the slot. The retaining nipple is designed for facilitating retention of the protrusion within the slot during use.

In an embodiment, the protrusion includes an indent 32 positioned to receive the retaining nipple when the protrusion is positioned in the slot.

An abrasive scrubbing pad 34 is coupled to and extends outwardly from the scrubber portion. The scrubbing pad is constructed of nylon and is elongated and aligned with the scrubber portion. The scrubbing pad is designed to have a width sized to correspond to a width of grout between adjacently positioned tiles. In an embodiment, a plurality of interchangeable scrubber portions is provided to permit switching between various widths to correspond to differing grout widths as desired.

A generally cylindrical grip 38 is formed from a resilient material such as foam rubber. The grip is positioned at a distal end of the distal portion of the handle assembly and includes a plurality of spaced circumferential grooves 39. Each of the grooves is positioned in a respective plane perpendicular to a longitudinal axis of the grip for facilitating comfortable grasping of the grip from various angles to permit use of the scrubber assembly in various orientations relative to the user during use.

In an embodiment, a hole 42 extends through a distal end of the distal portion of the handle assembly for facilitating hanging of the scrubber assembly by the handle assembly when not in use.

In alternate embodiments, the handle assembly includes two different styles having similar engagement portions and different distal portions. In the first style of handle assembly 50, the distal portion 52 is elongated such that the handle assembly is designed for permitting scrubbing of a low elevation surface by an upright user without the user having to bend over. The elongated distal portion 52 has two separable sections 46 and 48 for facilitating storage of the scrubber when not in use. The sections are each constructed of either metal or plastic. The separable sections are threadably couplable to each other. A longitudinal axis of the distal portion 52 forms about a 135-degree angle with a longitudinal axis of the engagement portion. The distal portion 52 has a length of about 48 inches and the engagement portion has a length of about 6 inches.

The second style of handle assembly 60 has a distal portion 62 that includes an offset portion 64 and a grip portion 66 extending outwardly from the offset portion. A longitudinal axis of the grip portion 66 is coplanar with respect to a longitudinal axis of the offset portion and the longitudinal axis of the grip portion further is positioned substantially parallel to a longitudinal axis of the scrubber portion. The grip 38 as described above, is coupled to a distal end 68 of the grip portion 66.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scrubber assembly, comprising:

a scrubber portion;

a handle assembly having an engagement portion and a distal portion extending outwardly from the engagement portion, the engagement portion of the handle assembly being slidably couplable to the scrubber portion;

the distal portion of said handle assembly being angled relative to said engagement portion;

a longitudinal axis of the engagement portion forming a generally obtuse angle relative to a longitudinal axis of the distal portion;

an elongated protrusion extending along a lower surface of the engagement portion, the protrusion having a generally trapezoidal cross section taken perpendicular to a longitudinal axis of the protrusion, a length of a distal side of said cross section being longer than a length of a proximal side of said cross section;

said scrubber portion having an elongated slot, said slot having a complimentary configuration to said protrusion such that said slot snugly receives said protrusion when said protrusion is slid into said slot whereby said scrubber portion is engaged to said engagement portion; and said slot having a retaining nipple positioned therein for engaging said protrusion when said protrusion is inserted into said slot, said retaining nipple being for facilitating retention of said protrusion within said slot during use, said retaining nipple being aligned with said longitudinal axis of said distal portion when said protrusion is fully received in said slot such that force along said longitudinal axis of said distal portion facilitates frictional engagement of said retaining nipple by said protrusion when said distal portion is being grasped during use.

2. The scrubber of claim 1, further comprising:

said protrusion having an indent positioned to receive said retaining nipple when said protrusion is positioned in said slot.

3. The scrubber of claim 1, further comprising:

said distal portion of said handle assembly being elongated such that said handle assembly is adapted for permitting scrubbing of a low elevation surface by an upright user without bending over by the user.

4. The scrubber of claim 3, further comprising:

said elongated distal portion having two separable sections for facilitating storage of the scrubber when not in use, said separable sections being threadably couplable to each other.

5. The scrubber of claim 1, further comprising:

an abrasive scrubbing pad coupled to and extending outwardly from the scrubber portion, the scrubbing pad being elongated and aligned with the scrubber portion; and the scrubbing pad having a width adapted to correspond to a width of grout between adjacently positioned tiles.

6. The scrubbing assembly of claim 1, further comprising:

the distal portion of the handle assembly having an offset portion and a grip portion extending outwardly from the offset portion, a longitudinal axis of the grip portion being coplanar with respect to a longitudinal axis of the offset portion, the longitudinal axis of the grip portion further being positioned substantially parallel to a longitudinal axis of the scrubber portion.

7. The scrubber assembly of claim 1, further comprising:

a longitudinal axis of said distal portion forming about a 135-degree angle with a longitudinal axis of said engagement portion.

8. The scrubber assembly of claim 1, wherein said distal portion of said handle assembly has a length of about 48 inches and said engagement portion has a length of about 6 inches.

9. The scrubber assembly of claim 1, further comprising:

a generally cylindrical grip formed from a resilient material, said grip being positioned at a distal end of said distal portion; and wherein said grip includes a plurality of spaced circumferential grooves, each of said grooves being positioned in a respective plane perpendicular to a longitudinal axis of said grip.

10. The scrubber assembly of claim 1, further comprising:

a hole extending through a distal end of the distal portion of the handle assembly, said hole being for facilitating hanging of said scrubber assembly by said handle assembly when not in use.

11. A scrubber assembly, comprising:

a scrubber portion;

a handle assembly having an engagement portion and a distal portion extending outwardly from the engagement portion, the engagement portion of the handle assembly being slidably couplable to the scrubber portion;

the distal portion of said handle assembly being angled relative to said engagement portion;

a longitudinal axis of the engagement portion forming a generally obtuse angle relative to a longitudinal axis of the distal portion;

an elongated protrusion extending along a lower surface of the engagement portion, the protrusion having a generally trapezoidal cross section taken perpendicular to a longitudinal axis of the protrusion, a length of a distal side of said cross section being longer than a length of a proximal side of said cross section;

said scrubber portion having an elongated slot, said slot having a complimentary configuration to said protrusion such that said slot snugly receives said protrusion when said protrusion is slid into said slot whereby said scrubber portion is engaged to said engagement portion;

said slot having a retaining nipple positioned therein for engaging said protrusion when said protrusion is inserted into said slot, said retaining nipple being for facilitating retention of said protrusion within said slot during use, said retaining nipple being aligned with said longitudinal axis of said distal portion when said protrusion is fully received in said slot such that force along said longitudinal axis of said distal portion facilitates frictional engagement of said retaining nipple by said protrusion when said distal portion is being grasped during use;

said protrusion having an indent positioned to receive said retaining nipple when said protrusion is positioned in said slot;

an abrasive scrubbing pad coupled to and extending outwardly from the scrubber portion, the scrubbing pad being elongated and aligned with the scrubber portion;

the scrubbing pad having a width adapted to correspond to a width of grout between adjacently positioned tiles;

a generally cylindrical grip formed from a resilient material, said grip being positioned at a distal end of said distal portion of said handle assembly;

wherein said grip includes a plurality of spaced circumferential grooves, each of said grooves being positioned in a respective plane perpendicular to a longitudinal axis of said grip;

a hole extending through said distal end of the distal portion of said handle assembly, said hole being for facilitating hanging of said scrubber assembly by said handle assembly when not in use; and said handle assembly being a handle assembly chosen from the group of handle assemblies consisting of a first handle assembly and a second handle assembly;

wherein said distal portion of said first handle assembly is elongated such that said first handle assembly is adapted for permitting scrubbing of a low elevation surface by an upright user without bending over by the user, and wherein said elongated distal portion of said first handle assembly has two separable sections for facilitating storage of the scrubber when not in use, said separable sections being threadably couplable to each other, wherein a longitudinal axis of said distal portion of said first handle assembly forms about a 135 degree angle with a longitudinal axis of said engagement portion, and wherein said distal portion of said first handle assembly has a length of about 48 inches and said engagement portion has a length of about 6 inches, and the distal portion of the second handle assembly having an offset portion and a grip portion extending outwardly from the offset portion, a longitudinal axis of the grip portion of the second handle assembly being coplanar with respect to a longitudinal axis of the offset portion, the longitudinal axis of the grip portion further being positioned substantially parallel to a longitudinal axis of the scrubber portion.

* * * * *